US005303325A

United States Patent [19]

Pasternak et al.

[11] Patent Number: 5,303,325

[45] Date of Patent: Apr. 12, 1994

[54] AIR HEATER

[75] Inventors: Timothy J. Pasternak, Lake Villa, Ill.; Wilson G. Zeitler, Westerville, Ohio

[73] Assignee: Abbott Laboratories, Abbott Park, Ill.

[21] Appl. No.: 959,576

[22] Filed: Oct. 13, 1992

[51] Int. Cl.[5] ..... F24H 3/00

[52] U.S. Cl. ..... 392/379; 392/368; 219/541; 219/539; 422/307

[58] Field of Search ..... 392/360, 365, 367, 368, 392/373, 374, 379, 380, 383, 384, 385; 53/557; 34/96–101; 422/307; 219/541, 539; 454/274, 324

[56] References Cited

U.S. PATENT DOCUMENTS

| | | | |
|---|---|---|---|
| 975,073 | 11/1910 | Roberts et al. | 219/223 |
| 1,811,589 | 6/1931 | Morris | 454/324 |
| 3,094,606 | 6/1963 | Ferris | 392/385 |
| 3,109,083 | 10/1963 | Meltzer | 392/385 |
| 3,566,575 | 3/1971 | Lisiecki | 53/406 |
| 3,694,626 | 9/1972 | Harnden | 219/541 |
| 3,744,209 | 7/1973 | Conley et al. | 53/406 |
| 3,916,149 | 10/1975 | Skinner | 392/501 |
| 4,088,444 | 5/1978 | Byrne | 432/25 |
| 4,233,494 | 11/1980 | Pawlik et al. | 392/488 |
| 4,254,324 | 3/1981 | Vrtaric | 392/385 |
| 4,409,775 | 10/1983 | Brody et al. | 53/167 |
| 4,424,189 | 1/1984 | Hick | 422/27 |
| 4,494,363 | 1/1985 | Rica et al. | 53/426 |
| 4,636,617 | 1/1987 | Petersen et al. | 392/379 |
| 4,680,163 | 7/1987 | Blidschun et al. | 422/28 |
| 4,686,891 | 8/1987 | Pouchard | 454/324 |
| 4,734,268 | 3/1988 | Redding et al. | 422/292 |
| 4,742,667 | 5/1988 | Müller et al. | 53/167 |
| 4,896,478 | 1/1990 | Reiter | 53/426 |
| 5,134,684 | 7/1992 | Mishou et al. | 392/486 |

*Primary Examiner*—Bruce A. Reynolds
*Assistant Examiner*—Gregory Mills
*Attorney, Agent, or Firm*—Donald O. Nickey; Lonnie R. Drayer

[57] ABSTRACT

An air heater is used to supply sterile air to an aseptic system for packaging food products. The air heater has an electrical heating element disposed within a tube, and the rate of air flow through the tube is adjustable. The air heater eliminates sources of contamination which are present in prior art air heaters.

14 Claims, 5 Drawing Sheets

AIR HEATER

TECHNICAL FIELD

The present invention relates generally to heaters, and more particularly, to a novel air heater for providing sterile air in an aseptic packaging system.

BACKGROUND ART

For years, packaging of food products for ambient temperature storage and distribution has been primarily conducted in glass or metal containers. The costs associated with these containers, their closures, and their labels have increased and are projected to continue to rise. Utilization of thermoplastic materials would conserve more energy on a packaging and distribution systems basis. Additionally, the costs would not be as great. Therefore, it would be extremely desirable to provide more food products packaged in thermoplastic material.

Additionally, in the processing of foods there have generally been two approaches to the packaging of food products in a container. The first method utilizes retorting, whereby a food product is placed in a container, the container is sealed and then the product and container are subjected to heat, such that the product is sterilized. In the second method, a container is subjected to a sterilizing process prior to its receiving sterilized food product. Conventional processes for sterilizing containers in which food stuff are subsequently packaged include UV irradiation, treatment with a mixture of steam and air, and an aseptic technique in which the interior wall of the container is sprayed with hydrogen peroxide and subsequently dried.

It can be appreciated that because of the heat sensitivity of most thermoplastics, conventional retort sterilization techniques can damage or destroy most thermoplastic packages of the type capable of containing food product under ambient conditions for prolonged periods. On the other hand, the application of aseptic packaging would permit increased usage of thermoplastic packaging materials, since application of aseptic techniques would leave the package unaltered and undamaged. Additionally, a food product subjected to aseptic packaging incurs minimal alteration due to processing, thereby theoretically yielding a higher quality-end product.

Experience has shown hydrogen peroxide to be a particularly reliable sterilizing agent for killing microorganisms in food product containers. The germicidal action of peroxide depends upon the formation of the hydrogen peroxide free radical in the formation of free oxygen. The free oxygen being formed during thermal decomposition of $H_2O_2$ exhibits a particularly strong sterilizing affect at the moment of formation. The efficiency of the wet aseptic process is attributable to the hydrogen peroxide being able to penetrate the cell walls of microorganisms.

Hydrogen peroxide is a chemical irritant. It is therefore necessary to obtain residual levels of less than 0.5 ppm (parts per million) before contact with the food product. The removal of the peroxide introduced into the food product container is typically achieved by evaporation, and thus an aseptic process requires the heating of the food product container after the introduction therein of the peroxide.

U.S. Pat. No. 4,742,667 discloses a method and an apparatus for aseptic packaging. The general components of the system taught in that particular patent are typical of the components in many aseptic packaging systems. In operation, a food product container arrives at a sterilization station. Hydrogen peroxide or another suitable disinfectant is applied to the inner surface of the container. Oftentimes, the application involves atomization of a liquid so that a mist is applied. After application of the disinfectant, the container is transported along a conveyor, during which transport the food product container is subjected to additional sprayings of hot air.

The amount of disinfectant, the temperature of the initial disinfectant spray, the temperature of the air and the volume of the air all affect the killing of any microorganisms which may be present inside of the container. Since the residual peroxide concentration must be greatly reduced prior to introduction into the food product container of actual food product, the temperature and the air flow rate are critical. Typically a plurality of air heaters are utilized in drying the food product containers.

An example of an aseptic packaging machine or filler is the type manufactured by FMC Corporation, and known as Metal Box, a former division of CMB Engineering Group, PLC. These aseptic packaging systems utilize an air heater fabricated with bare heater element wire wound around ceramic insulator blocks. The heater element wire comprises nickel and chrome. The heater element is contained within an air supply tube.

This type of air heater has several drawbacks. First, over time, the nickel chromium wire tends to oxidize. The oxide, due to the passage thereover of air, tends to flake and create the possibility of contamination of the ultimately packaged food product. The problem is exacerbated by the fact that the oxide has been linked to being a carcinogen. Another disadvantage is the fact that the passage of air over the ceramic insulator blocks in the presence of the intense heat generated by the bare heater element wire causes the degradation of the ceramic material. Actual usage of the prior art air heater has resulted in the actual loss of ceramic material, which most likely ended up being introduced into the area in the aseptic packaging system where the hot air is introduced into the food product containers. This presents the possibility of particulate contamination of the packaging prior to filling.

One other drawback associated with the prior art air heater is the fact that while the temperature of the air upon impact with the food product containers may need to be in the range of 71°–82° C. (160–180° F.), this requires the heater element wire to have a surface temperature of well in excess of 538° C. (1000° F.). In some sterilization operations, it became necessary to increase the temperature of the heater element wire beyond the recommended temperature.

Finally, the prior art air heater elements also do not provide an easy and effective means for adjusting the air flow through the air heater. While some air heaters would permit adjustment of air flow, it typically became necessary to remove the heater from the system in order to accomplish the adjustment. This creates problems with the maintenance of a sterile environment within the aseptic packaging system.

It is thus apparent that the need exists for an improved air heater which permits the adjustment of air flow and eliminates the possibility of both particulate and chromium oxide contamination. It is also apparent that the need exists for an air heater which can be used in association with an aseptic packaging system to permit adjustments to the rate of air flow to maintain the sterile environment of the sterilization system.

DISCLOSURE OF THE INVENTION

There is disclosed an air heater assembly comprising a housing encasing a heating element, with the heating element comprising a plurality of coiled members joined together. The heating element also comprises a metallic heat conducting element retained within a metallic sheath. The air heater assembly also comprises a connector assembly for electrically connecting the heater assembly to an electrical circuit, with the connector assembly comprising a support bar having secured thereto a pair of connector plates, each of which connector plates is also secured to the metallic heat conducting element.

The connector assembly also comprises a main plug connected to the support bar and to the housing. The metallic sheath passes through this main plug. The air heater assembly also comprises an air flow entry member which is attached to the housing. The air flow entry member comprises a fixed plate having formed therein a plurality of orifices, and a slidably cooperating plate having formed therein a plurality of orifices. The slidably cooperating plate is adjustable relative to the fixed plate so as to vary the rate of the flow of air through the heater assembly.

Preferably the slidably cooperating plate is positioned directly adjacent the fixed plate. Also preferably, the metallic heat conducting element comprises chromium and nickel, and the metallic sheath comprises stainless steel. The heat conducting element is suspended within the metallic sheath in an insulative layer comprising magnesium oxide.

The slidably cooperating plate comprises a pair of notches located on the opposite edges of the plate. The air flow entry unit comprises a pair of screws which mechanically engage the notches. These screws are cooperatively adjustable such that when they are adjusted they cause the slidably cooperating plate to move relative to the fixed plate so as to effect a change in the rate of the flow of air through the orifices of the slidably cooperating plate and the fixed plate respectively. The support bar comprises an upper planar surface, an intermediate planar surface, a bottom surface, and a pair of channels extending between the intermediate planar surface and the bottom surface. Each of the channels is adapted to receive a respective connector plate.

There is also disclosed an air heater assembly comprising an air flow entry member, a heating element, and a connector assembly for electrically connecting the heater assembly to an electrical circuit. The air flow entry member comprises means for varying the rate of air flow therethrough. The heating element is contained within a housing, which housing comprises means for channeling air flow egress. The connector assembly comprises means for connecting the heating element to the electrical circuit with the means for connecting the heating element to the electrical circuit comprising a pair of connector plates, means for securing the heating element to the pair of connector plates, and means for securing the electrical circuit to the pair of connector plates.

The means for varying the rate of air flow comprises a slidably cooperating plate positioned adjacent a fixed plate. The fixed plate has formed therein a plurality of orifices as does the slidably cooperating plate. The slidably cooperating plate is adjustable relative to the fixed plate so as to vary the rate of the flow of air through the heater assembly. The heating element comprises a metallic heat conducting element comprising chromium and nickel, and a metallic sheet comprising stainless steel. The metallic heat conducting element is suspended within the metallic sheath in an insulative layer comprising magnesium oxide.

The slidably cooperating plate comprises a pair of notches located on opposite edges of the plate. The air flow entry member comprises a pair of screws which mechanically engage the notches with these screws being cooperatively adjustable. These screws, when adjusted, cause the slidably cooperating plate to move relative to the fixed plate so as to effect a change in the rate of the flow of air through the orifices of the slidably cooperating plate and the fixed plate respectively. The means for connecting the heating element to the electrical circuit comprise a pair of channels. Each one of these channels is adapted to receive one of the connector plates. The heating element comprises a plurality of coiled members joined together and oriented parallel to each other.

There is also disclosed an air heater assembly for use in aseptic packaging systems. The heaters are used in combination with others of the same air heater assembly structure, with each air heater assembly comprising an air flow entry member, a heating element, and a connector assembly for electrically connecting the heater assembly to an electrical circuit. The air flow entry member comprises means for affecting the rate of air flow therethrough. The heaters are adapted to vary the rate of air flow through respective heater assemblies while maintaining within the packaging system a sterile environment. The heating element is contained within a housing, with the housing comprising means for channeling air flow egress. The connector assembly comprises means for connecting the heating element to the electrical circuit with the means for connecting the heating element to the electrical circuit comprising a pair of connector plates, means for securing the heating element to the pair of connector plates, and means for securing the electrical circuit to the pair of connector plates.

The means for effecting the rate of air flow comprise a slidably cooperating plate positioned adjacent a fixed plate. The fixed plate and the slidably cooperating plate both have formed therein a plurality of orifices. The slidably cooperating plate is adjustable relative to the fixed plate so as to vary the rate of the flow of air through one of the heater assemblies. The heating element comprising a metallic heat conducting element comprising chromium and nickel and a metallic sheath comprising stainless steel. The metallic heat conducting element is suspended within the metallic sheath in an insulative layer comprising magnesium oxide.

The slidably cooperating plate comprises a pair of notches located on opposite edges of the slidably cooperating plate. The air flow entry member comprises adjustment means which engage the notches. The adjustment means are selectively adjustable, such that it is adapted to cause the slidably cooperating plate to move relatively to the fixed plate so as to effect a change in the rate of the flow of air through the orifices of the slidably cooperating plate and the fixed plate respectively. The means for connecting the heating element to the electrical circuit comprise a pair of channels, each one of which is adapted to receive one of the connector plates. The heating element comprises a plurality of coiled members joined together, with the coiled members being oriented parallel to each other.

The present invention provides an apparatus for use in aseptic packaging. Particulate and chemical contamination due to the heater assemblies are eliminated. In addition, the ability of the heater assemblies to have the rate of air flow varied, with this adjustment being able to be done so as to maintain the packaging system in a sterile environment, permits the packaging system to have greater flexibility.

Other aspects and advantages of the invention will be apparent from the following description, the accompanying drawings, and the appended claims.

DETAILED DESCRIPTION OF THE INVENTION

Figure 1:
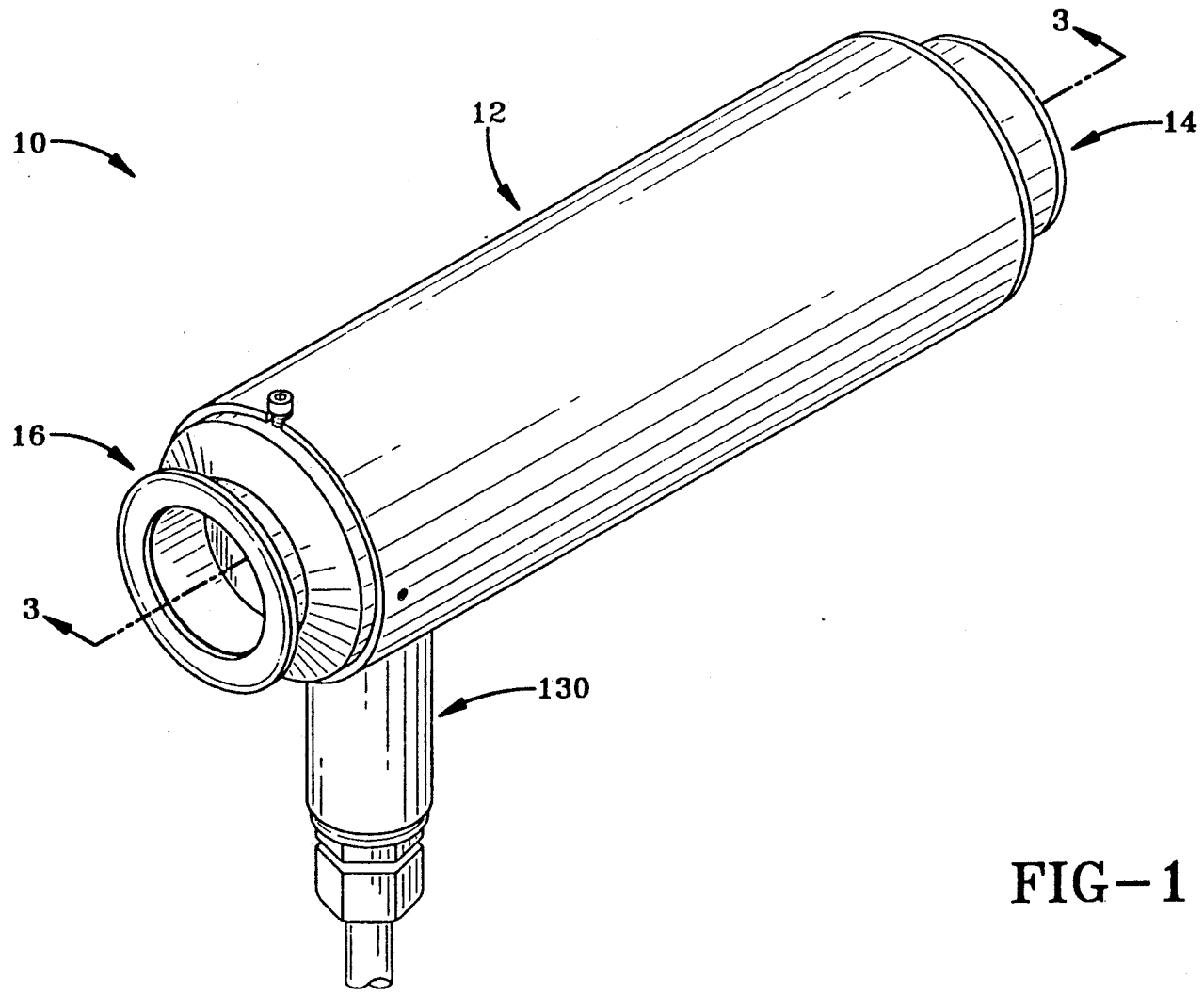
FIG. 1 is a perspective view of an air heater assembly made in accordance with the present invention.
Figure 2:
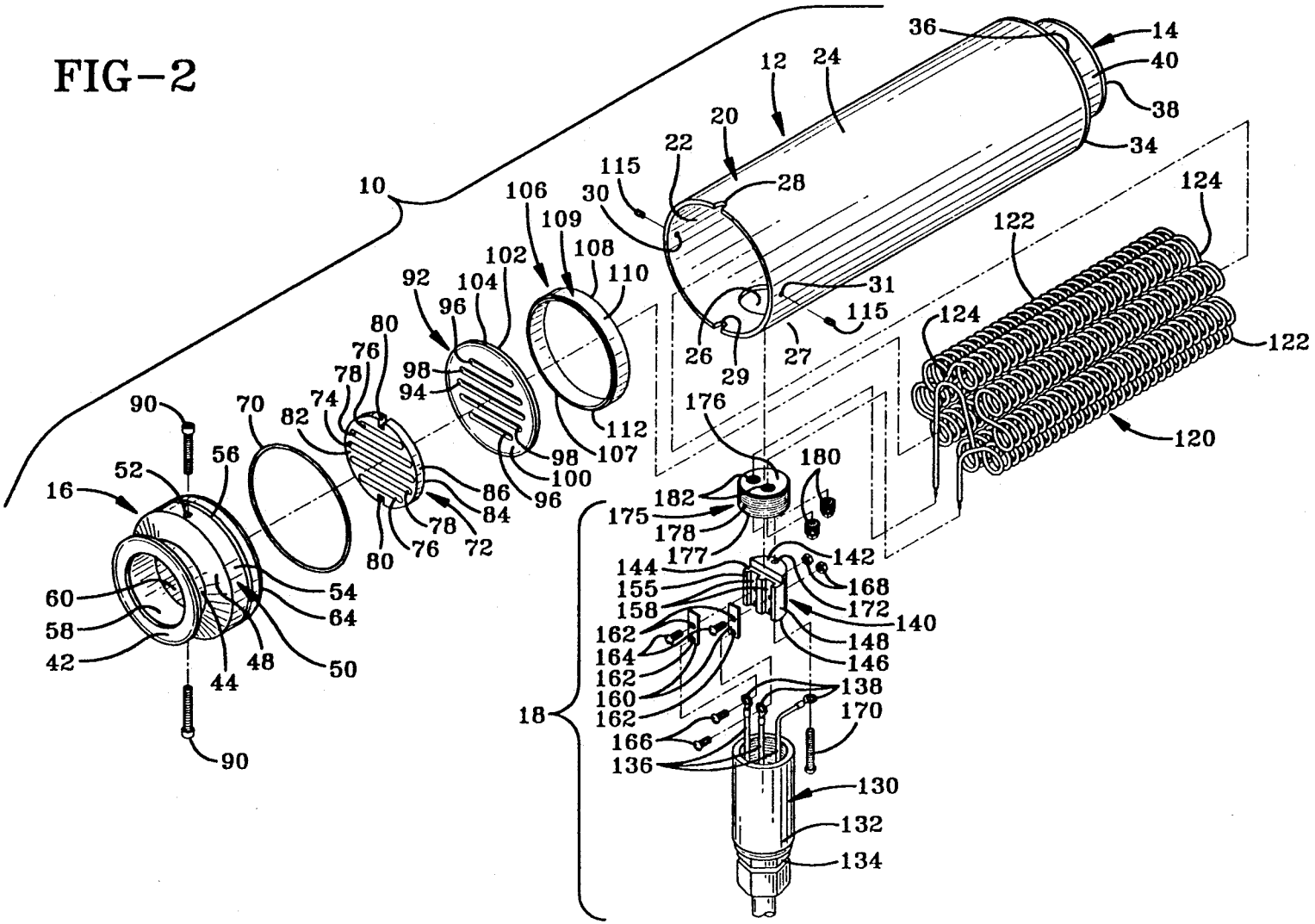
FIG. 2 is an isometric exploded view of an air heater assembly made in accordance with the present invention.

Having reference to the drawings, attention is directed first to FIGS. 1 and 2, and in particular to FIG. 2 which illustrates an exploded isometric view of an air heater made in accordance with the present invention designated generally by the numeral 10. An air heater in accordance with the present invention has utility for providing sterile air in an aseptic packaging system. The basic components of the invention are a main tube 12, a main tube end piece 14, an adapter cap 16, and a connector assembly 18.

The main tube 12 is preferably a stainless steel tube having a sidewall 20, with the sidewall 20 having an inner surface 22 and an outer surface 24. A connector assembly aperture 26 is formed in sidewall 20. This connector assembly aperture 26 is preferably formed adjacent the first end 27 of the main tube. Preferably formed in the main tube first end 27 are a pair of adjustment screw notches 28 and 29 respectively. Furthermore, a pair of set screw apertures 30 and 31 respectively are formed in the sidewall 20 of the main tube 12, with the set screw apertures 30 and 31 preferably being formed on opposite sides of the main tube and in a vertical plane between the main tube first end 27 and the connector assembly aperture 26.

At the opposite end of the main tube 12 from the first end 27 is the main tube second end 34. As can be better appreciated from a comparison of FIGS. 2 and 3, this second end 34 is adjacent the main tube end piece 14, and more particularly, directly adjacent to the end wall 36. The end wall 36 is formed as part of the main tube end piece 14. Additionally, the main tube end piece 14 has an aperture 38 formed therethrough with this aperture having a sidewall 40 which extends from the end wall 36 to the opposite end of the main tube end piece 14.

The adapter cap 16 is comprised of an adapter cap end wall 42 which end wall is adjacent to a valley 44 formed in the sidewall of the adapter cap 16. This valley 44 includes a first inclined wall 46 as well as a second inclined wall 48. The cap sidewall 50 also has formed therein two cap apertures 52. The cap sidewall outer surface 54 between the apex of the second inclined wall 48 and the region lying directly inwardly adjacent the sidewall 20 of main tube 12 is relatively flat except for the presence of a groove 56, as can best be seen in a comparison of FIGS. 2, 3 and 5.

Meanwhile, the adapter cap 16 has an inner sidewall comprising a first surface portion 58 which extends from the end wall 42 to a first intermediate edge 59. The first intermediate edge extends outwardly preferably in a vertical direction to a cap sidewall second inner surface portion 60. This second inner surface portion 60 extends for only a short distance to a second intermediate edge 61. The second intermediate edge 61 extends further in an outward direction to a cap sidewall third inner surface portion 62. The third inner surface portion extends to the adapter cap inner edge 64. When assembled, as can be appreciated from a comparison of FIGS. 1, 3 and 5, it can be appreciated from a comparison of those figures with FIG. 2 that set screws 115 installed in set screw apertures 30 and 31 respectively serve to frictionally engage with the outer surface 24 of the sidewall 20 of the main tube, thereby securing the press-in-ring 106, the fixed orifice plate 92, and the movable orifice plate 72 all within the adapter cap 16 with the outer wall 82 of movable orifice 72 positioned directly adjacent the first intermediate edge 59 of the adapter cap.

Figure 3:
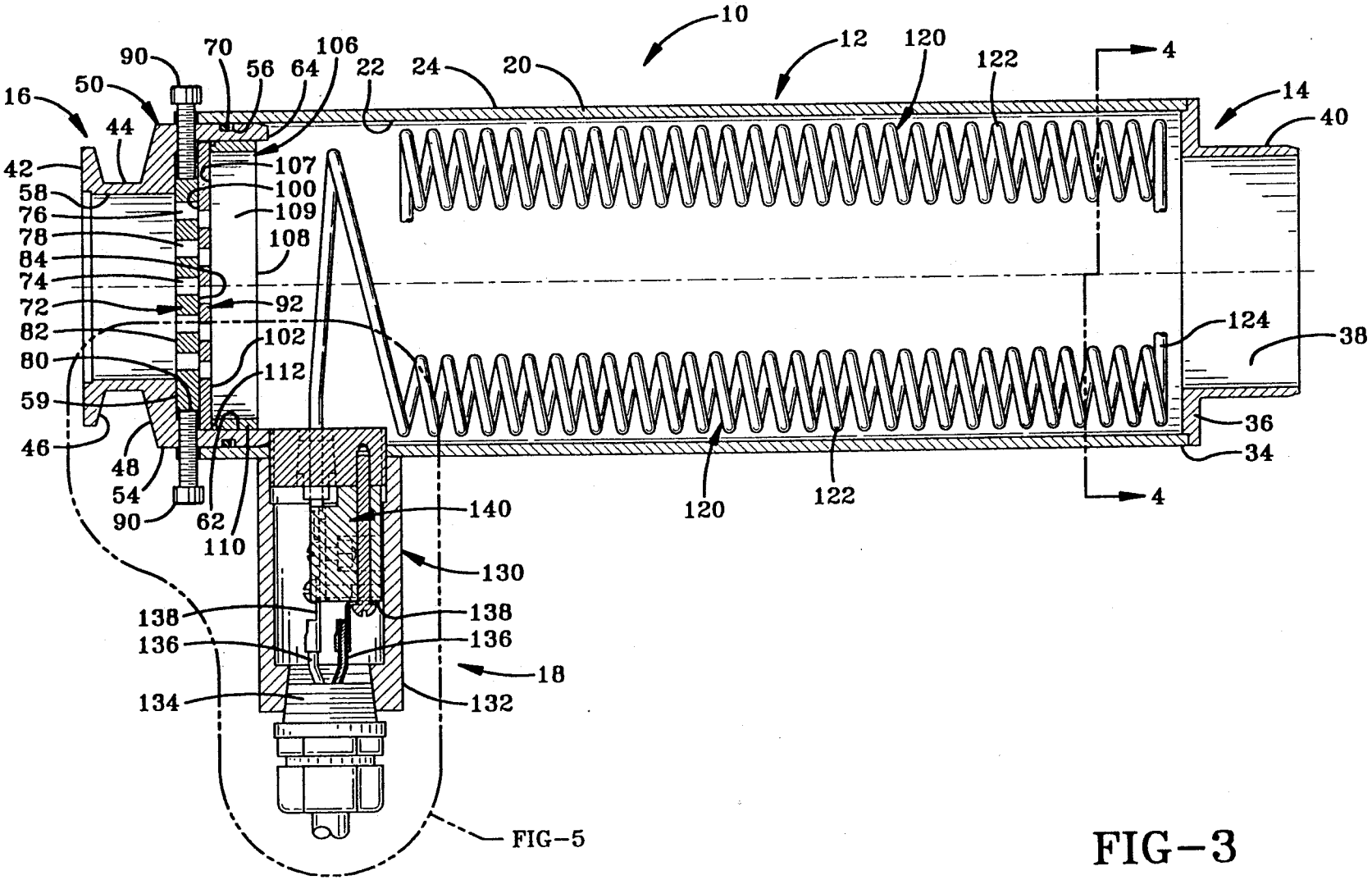
FIG. 3 is a vertical sectional view taken along line 3—3 of FIG. 1.
Figure 5:
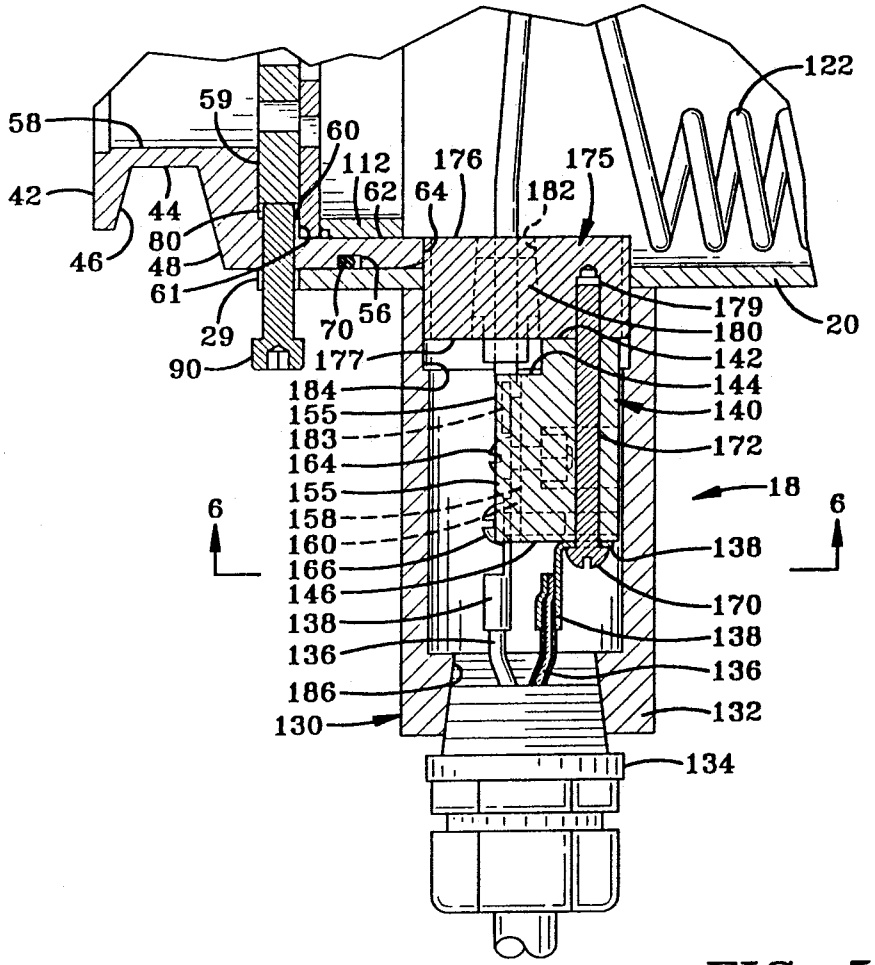
FIG. 5 is a partial vertical sectional view on an enlarged scale of the area encircled in FIG. 3.

An O-ring 70 is provided as can be appreciated from a comparison of FIGS. 2, 3 and 5. The O-ring 70 is placed over the cap sidewall outer surface 54 and positioned into the groove 56. The adapter cap 16 also has placed therein the movable orifice plate 72. As can be appreciated from a comparison of FIGS. 2, 3, 5 and 8, the movable orifice plate 72 is a plate having formed therein a center slot 74, a pair of outermost slots 76 and a pair of intermediate slots 78. It can be appreciated that the movable orifice plate has a pair of notches 80, an outer wall 82, an inner wall 84, and a sidewall 86. Both the movable orifice outer wall and inner wall, 82 and 84 respectively, are planar, and the movable orifice notches are preferably formed on opposite sides of sidewall 86. It can also be appreciated that a pair of adjustment screws 90 are provided, which screws cooperatively engage with the notches 80 in the movable orifice plate 72 so as to effect the movement of that plate within the air heater 10 in a manner which will be discussed below.

FIGS. 2, 3, 5 and 9 also disclose a fixed orifice plate 92 which is a plate having formed therein a center slot 94, a pair of outermost slots 96, and a pair of intermediate slots 98. The fixed orifice plate 92 also has an outer wall 100 and an inner wall 102, both of which are preferably planar and parallel not only to each other but also to the outer and inner wall 82 and 84 respectively of the movable orifice plate. The fixed orifice plate also has an outer sidewall 104.

A press-in-ring 106 is also provided having an outer edge 107, an inner edge 108, and sidewall 109 with the sidewall having an outer surface 110. The outer edge in the assembled embodiment of the air heater 10 rests flush against the inner wall 102 of the fixed orifice plate 92. Meanwhile, the inner edge 108 of the press-in-ring 106 is positioned adjacent the adapter cap inner edge 64, with the entire outer surface 110 of sidewall 109 being directly adjacent the cap sidewall third inner surface portion 62. The press-in-ring 106 also has a slight flange 112 formed in the outer edge 107 of the ring. When assembled, the press-in-ring frictionally engages the inner surface 22 of the main tube 12.

The air heater of this invention also utilizes a heating coil 120 as can be appreciated from a comparison of FIGS. 2, 3, and 5. The heating coil 120 is preferably formed from a plurality of coiled members 122, each of which resembles a metallic spring. The various coiled members 122 are shown as being positioned parallel to one another and joined together by connecting sections 124.

Figure 4:
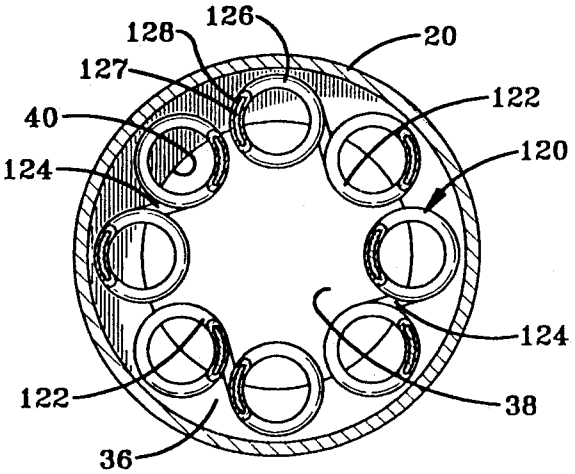
FIG. 4 is a vertical sectional view taken along line 4—4 of FIG. 3.
Figure 6:
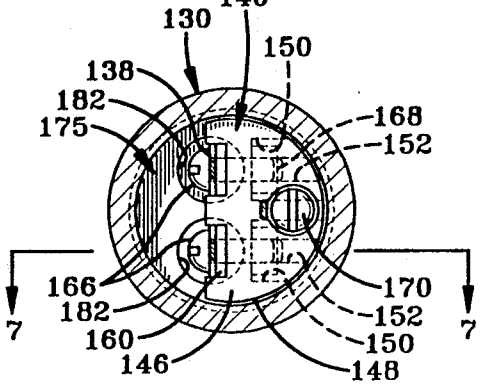
FIG. 6 is a horizontal sectional view taken along line 6—6 of FIG. 5.
Figure 8:
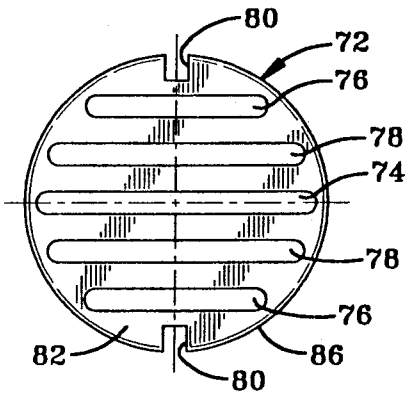
FIG. 8 is a front plan view of the slidably cooperating plate shown in FIG. 2.
Figure 9:
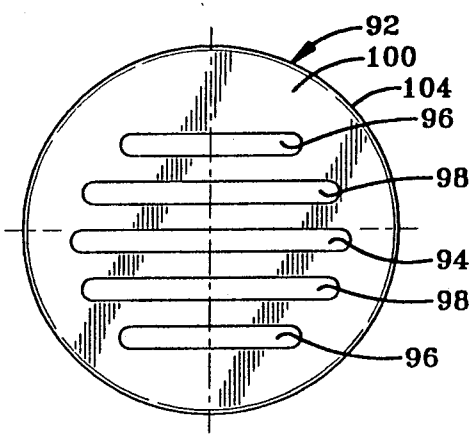
FIG. 9 is a front elevational view of the fixed plate shown in FIG. 2.
Figure 7:
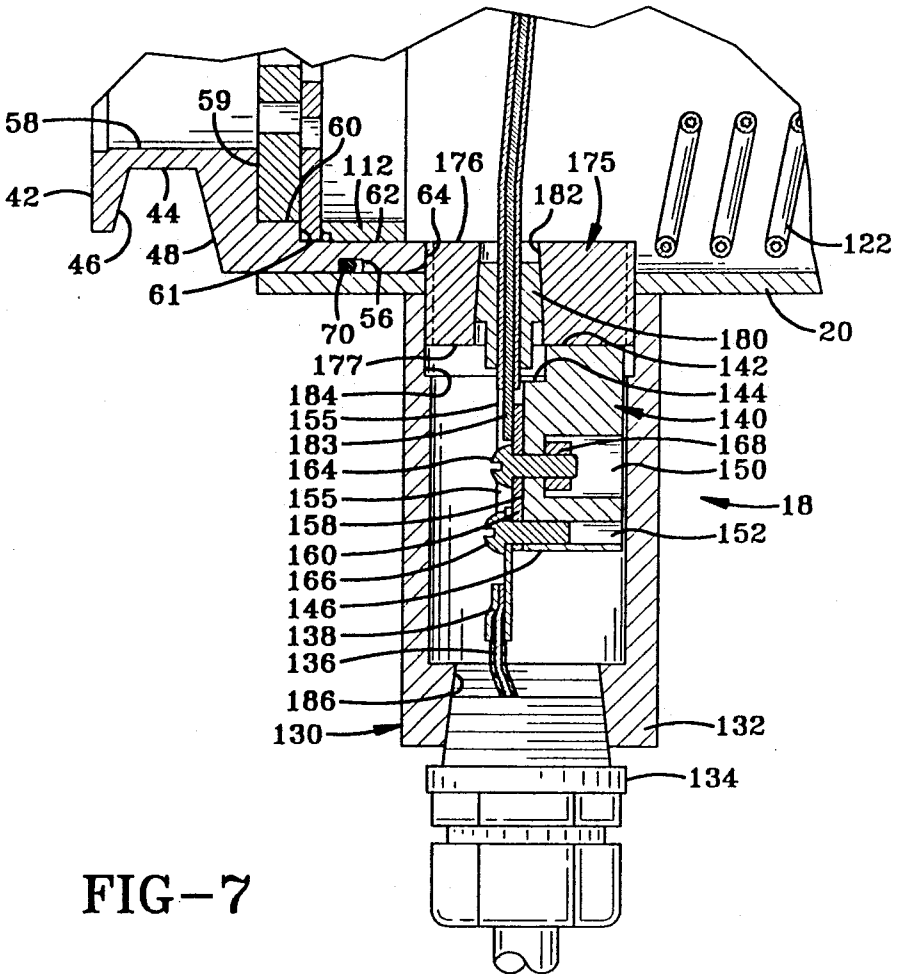
FIG. 7 is a vertical sectional view taken along line 7—7 of FIG. 6.

The heating coil of this invention has an outer layer preferably fabricated from stainless steel with this metallic sheath 126 surrounding a metallic heat conducting element 127 as illustrated in FIG. 4. Preferably the metallic heat conducting element 127 is a wire comprising nickel and chrome, and more preferably a nickel chromium wire. The metallic heat conducting element 127 is suspended within the metallic sheath 126 by an insulative layer comprising magnesium oxide or some other insulative substance 128 as shown in FIG. 4.

The connector assembly 18 comprises a threaded coupling 130 having at its bottom surface 132 a standard box connector 134 secured thereto, as can best be appreciated from a comparison of FIGS. 2, 3, 5 and 6. Retained within the interior of the threaded coupling 130 is a support bar 140. This support bar 140 has an upper planar surface 142, an intermediate planar surface 144, a bottom surface 146, and an outer sidewall 148.

Formed in the support bar 140 are a first set of recesses 150 and a second set of recesses 152, with the first set of recesses 150 preferably being greater in size than the second set of recesses 152. On the front face 155 of the support bar 140, are two support bar channels 158 which extend from the intermediate planar surface 144 to the bottom surface 146 in a vertical direction. A pair of connector plates 160 are retained within the support bar channels 158. Each of the connector plates 160 have a pair of connector plate apertures 162 formed therein through which first connector plate screws 164 and second connector plate screws 166 pass. The first connector plate screws 164 extend through the first set of recesses 150 and are secured to the support bar 140 by nuts 168. Meanwhile, the second connector plate screws 166 pass through the connector plates 160 and terminate within the second set of recesses 152. As can be appreciated from a comparison of FIGS. 2 and 5, a connecting screw 170 extends upwardly from the bottom surface 146 of the support bar through a connecting screw aperture 172.

As can also be appreciated from a comparison of FIGS. 2, 3, 5, and 7, a main plug 175 is also provided. The main plug 175 has a top 176, a bottom 177, sidewall 178, and an aperture 179 extending upwardly from the main plug bottom 177. This main plug aperture is oriented such that the connecting screw 170 extends through the connecting screw aperture 172 into the main plug aperture 179, therefore, providing additional securing of the support bar 140 to the main plug 175.

Main plug 175 has inserted thereinto a pair of pipe plugs 180 with these pipe plugs 180 being inserted for frictional fit into pipe plug apertures 182 having a greater diameter at the bottom than at the top of the main plug 175. The metallic sheath 126 of the heating coil 120 passes through the pipe plug 180 as can be appreciated from FIGS. 3 and 7. The heating coil 120 is formed so as to have a pair of exposed ends 183 with these exposed ends 183 in reality being the metallic heat conducting element. The main plug 175 is secured within the upper portion of the threaded coupling 184 just as the box connector 134 is secured within the bottom portion of the threaded coupling 186.

BEST MODE

The air heater assembly of this invention is assembled as follows. The heating coil is fabricated as shown by having a total of 8 coiled members each of which are wound on a 1.6 cm (⅝") diameter mandrel with 28 coils per coiled member, such that each coiled member is approximately 20.3 cm (8") in length. Each of the connecting sections 124 are approximately 2.54 cm (1") in length.

The box connector 134 is secured to the bottom portion 186 of the threaded coupling 130. Preferably this is done using Teflon® tape between the threads of the box connector and the threaded coupling. That assembly is then slipped over the electrical circuitry 136 and secured to the eye-ring connectors 138.

The main plug 175 is then screwed into the connector assembly aperture 26 until it is approximately flush with the inner diameter of the main tube 12. It is then tack welded in place with the main plug aperture 179 positioned to the bottom. The exposed ends 183 of the heating coil 120 are then brought through the pipe plug aperture 182 in main plug 175. The pipe plugs 180 themselves are then slipped over the metallic sheath 126 and moved into frictional engagement with the main plug, being careful that no potential ground faults such as burrs or dents exist in the area of the exposed end 183 between the metallic heat conducting element 127 and the metallic sheath 126. The length of the exposed end 183 is cleaned to bright metal and then trimmed to 0.76 cm (0.30") in length. The connector plate is preferably fabricated from stainless steel, is 1.6 mm (0.062") thick, 2.3 mm (0.09") long, and 7.9 cm (0.312") wide. A 4.8 mm (6/32") hole is centered 3.0 mm (0.119") from the bottom end of the plate and a 3.6 mm (0.141") hole is centered 1.3 cm (0.525") from the bottom end. Each of the exposed ends 183 are then welded to their respective connector plate 0.25 cm (0.10") from the end of the metallic heat conducting element in the region between the uppermost hole and the top of the connecting plate. The exposed end should then be coated with FDA (Food and Drug Administration) approved high temperature silicone rubber or boron nitride spray.

The connector plate is then secured to the support bar by passing first connector plate screw 164 through the uppermost aperture in the connector plate, which set of apertures are non-threaded, with the first connector plate screws 164 allowing the connector plates 160 to be secured to the support bar 130 by nuts 168. The second connector plate screws 166 and the connecting screw 170 are then inserted through the eye-ring connectors 138. The connecting screw is then secured to the bottom surface 146 of the support bar, with the connecting screw aperture 172 both within the support bar and within the main plug 175 being threaded so as to effect further securing of the main plug to the support bar. The second connector plate screws 166 are then inserted through the lower set of apertures in the connector plates, which apertures are threaded, and thence into the second set of recesses 152 which are also preferably threaded.

The support bar is preferably fabricated from a phenolic, high temperature material. All of the bores in the support bar are preferably 0.36 cm (0.141"). The height of the support bar is 3.2 cm (1.25"), with the intermediate planar surface 144 being 0.56 cm (0.219") below the upper planar surface 142, and with the distance across the top of the intermediate planar surface being approximately 2.85 cm (1.124") and the top of the intermediate planar surface being 1.82 cm (0.718") deep. The first set of recesses 150 are bored at 0.89 cm (0.35"). The support bar channels 158 are 0.81 cm (0.320") wide and 0.32 cm (0.125") deep, with the section of the support separating the adjacent support bar channels 158 being 0.46 cm (0.18") wide. The first set of recesses 150 are also centered 1.31 cm (0.516") from the bottom surface 146 of the support bar and the second set of recesses 152 are centered 0.28 cm (0.109") from the bottom surface 146 of the support bar. The connecting screw aperture 172 extends through the portion of the support bar located between the pair of recesses 150 and is 1.35 cm (0.531") back from the front face 155.

The threaded coupling is preferably 7 cm (2.750") tall. It has an outer diameter of 3.8 cm (1.50"). A tap, 5.7 cm (2.25") long and 3 cm (1.172") in outer diameter, extends downwardly from the upper portion of the threaded coupling 184. The upper portion 184 has an additional 1.27 cm (0.50") tap having a 3.2 cm (1.250") outer diameter for accommodation of main plug 175.

The threaded main plug 175 has a 3.2 cm (1.250") outer diameter and is 1.6 cm (0.625") high. The main plug apertures 182 are preferably tapered such that at the top 176 the diameter of each of the main plug apertures 182 is 0.87 cm (0.344"), while at the main plug bottom 177 the diameter is 1.04 cm (0.410"). The centers of each of the apertures 182 are spaced 1.27 cm (0.5") from each other and are spaced approximately 0.32 cm (0.125") forward from the center line which runs parallel to the front face 155 of the support bar. The main plug aperture 179 is a 4.8 mm (6/32") drill and tap which is 0.97 cm (0.38") deep and located 0.95 cm (0.375") rearwardly of the aforementioned center axis.

The adapter cap 16 is assembled as follows. The O-ring 70 is positioned within the groove on the adapter cap. The movable orifice plate 74, the fixed orifice plate 92, and the press-in ring 106 are then sequentially placed within the adapter cap until there is a relatively snug fit. The set screws 115 are then tightened to keep the entire adapter cap assembly secured within the main tube 12 as shown in FIGS. 3 and 5.

The adapter cap itself is approximately 5.08 cm (2") from the end wall 42 to the inner edge 64. The end wall 42 has an outer diameter of approximately 7.53 cm (2.963") and an inner diameter of approximately 5.25 cm (2.066"). Both the first and second inclined walls 46 and 48 respectively are inclined 15° with respect to the valley 44. The valley itself has an outer diameter of 5.70 cm (2.244") and an inner diameter of approximately 5.03 cm (1.982"). The width of the valley is approximately 1.22 cm (0.48"). The groove is centered approximately 1.14 cm (0.448") from the inner edge 64.

The fixed orifice plate 92 is preferably fabricated from stainless steel and has five slots. The plate has an outer diameter of 7.89 cm (3.105") and is 0.32 cm (0.125") thick. Each of the slots has a width of 0.47 cm (0.187") with the centermost slot being 5.87 cm (2.312") in length, the outermost slots being 3.81 cm (1.5") in length, and the intermediate slots being 5.40 cm (2.126") in length. The slots are all spaced 1.03 cm (0.406") from the center line of each adjacent slot. The center line of the center slot is offset 2.4 mm (0.093") from the parallel center line of the plate.

The movable orifice plate has as its diameter 6.35 cm (2.5"), with the thickness being 0.64 cm (0.25"). Once again, each of the slots are 0.47 cm (0.187") in width, but the respective lengths of the center slot 74, intermediate slots 78, and outermost slots 76 are 5.40 cm (2.126"), 4.93 cm (1.940") and 3.34 cm (1.314"). The two notches are 0.48 cm (0.19") in width, with the bottom of each of the slots being 0.55 cm (0.218") from the center line of the outermost slot 76. Once again, each of the slots are spaced 1.03 cm (0.406") from the center line of the adjacent slot. As adjustment screws 90 are cooperatively and selectively adjusted, the adjustment causes the slidably cooperating plate 72 to move relative to the fixed plate. The press-in-ring 106 has an outer diameter of 7.96 cm (3.133") and an inner diameter of 7.32 cm (2.883"). The ring is 1.27 cm (0.5") wide and 0.64 cm (0.25") thick and is also preferably fabricated from stainless steel.

The main tube end piece is 3.18 cm (1.25") in length with the main tube end piece aperture having an inner diameter of 5.72 cm (2.25"). The sidewall 40 is 0.53 cm (0.21") thick and the end wall 36 is 0.48 cm (0.188") thick. The main tube end piece is preferably welded to the main tube 12 near the end of the assembly of the air heater.

INDUSTRIAL APPLICABILITY

The food processing industry has long sought to provide efficient aseptic packaging equipment. An important component of this equipment is an air heater which can heat sterile air in an aseptic packaging system and which can have the air flow through the air heater adjusted without compromising the sterile environment of the packaging system. Additionally, it is important that the passage of heated air over a heating element in an air heater not present the possibility of product contamination. This invention solves all of the aforementioned problems. A heater assembly manufactured according to this invention is extremely beneficial in the food processing industry.

In actual use, a plurality of these heater assemblies would preferably be used in an aseptic packaging system. After the food product container is sprayed with hydrogen peroxide, for example, the container would be placed under a first heater assembly with the slidably cooperating plate adjusted to restrict somewhat airflow through the heater. Thus, the air which would be blown into the food product container would have an extremely high temperature yet a relatively low rate of airflow. The highly heated air would tend to kill any micro-organisms still present as the food product container would move on so as to be subjected to air blown through other heater assemblies, the slidably cooperating plate would be adjusted to permit greater air flow through the tube irregardless of the temperature of the air. This higher rate of air flow is thought to be beneficial in driving any microorganisms which still might be clinging to the inside of the food product container. Consequently, the possibility of any contamination is greatly reduced in a packaging system utilizing a plurality of the air heaters of this invention. Additionally, the ability to affect the flow of air is believed to be beneficial in providing greater system flexibility as well as efficacy.

While the form of apparatus herein described, constitutes a preferred embodiment of the invention, it is to be understood that the invention is not limited to this precise form of apparatus, and that changes may be made therein without departing from the scope of the invention, which is defined in the appended claims.

We claim:

1. An air heater assembly adapted for connection to and use with an aseptic packaging system to make and maintain the same in a sterile condition, the air heater assembly comprising:

(a) a housing encasing a heating element, said heating element comprising a plurality of coiled members joined together, said coiled members each comprising a metallic heat conducting element retained within a metallic sheath;

(b) a connector assembly for electrically connecting said heater assembly to an electrical circuit, said connector assembly comprising a support bar having secured thereto a pair of connector plates, each of said connector plates also being secured to said metallic heat conducting element, said connector assembly also comprising a main plug, said main plug connected to said support bar and to said housing, said metallic sheath passing through said main plug; and (c) an air flow entry member, said air flow entry member attached to said housing and communicating therewith upstream from the heating element, said air flow entry member comprising a fixed plate having formed therein a plurality of orifices, and a slidably cooperating plate having formed therein a plurality of orifices, said slidably cooperating plate being slidably adjustable relative to said fixed plate so as to vary the rate of the flow of air through said heater assembly without compromising the sterility of the aseptic packaging system.

2. An air heater assembly according to claim 1 wherein said slidably cooperating plate is positioned directly adjacent said fixed plate.

3. An air heater assembly according to claim 1 wherein said metallic heat conducting element comprises chromium and nickel, and said metallic sheath comprises stainless steel.

4. An air heater assembly according to claim 3 wherein said heat conducting element is suspended within said metallic sheath in an insulative layer comprising magnesium oxide.

5. An air heater assembly according to claim 1 wherein said slidably cooperating plate comprises a pair of notches located on opposite edges of said plate, said air flow entry unit comprising a pair of screws which mechanically engage said notches, said screws being cooperatively adjustable, said screws when adjusted causing said slidably cooperating plate to move relative to said fixed plate so as to effect a change in the rate of the flow of air through the orifices of the slidably cooperating plate and the fixed plate respectively without compromising the sterility of the aseptic packaging system.

6. An air heater assembly according to claim 1 wherein said support bar comprises an upper planar surface, an intermediate planar surface, a bottom surface, a pair of channels extending between said intermediate planar surface and said bottom surface, each of said channels being adapted to receive a respective connector plate.

7. An air heater assembly according to claim 1 wherein said coiled members of said heating element are oriented parallel to each other.

8. An aseptic packaging system comprising an air heater assembly which comprises an air flow entry member, a heating element, and a connector assembly for electrically connecting said heating element to an electrical circuit, said air flow entry member comprising means for varying the rate of air flow therethrough to the heating element, while maintaining within said packaging system a sterile environment, said heating element being contained within a housing, said housing receiving air flow from the air flow entry member and directing the air flow egress, said means for connecting said heating element to said electrical circuit comprising a pair of connector plates, means for securing said heating element to said pair of connector plates, and means for securing said electrical circuit to said pair of connector plates.

9. An aseptic packaging system according to claim 8 wherein said means for varying the rate of air flow comprises a slidably cooperating plate positioned adjacent a fixed plate, said fixed plate having formed therein a plurality of orifices, said slidably cooperating plate having formed therein a plurality of orifices, said slidably cooperating plate being slidably adjustable relative to said fixed plate so as to vary the rate of the flow of air through said heater assembly without compromising the sterility of the aseptic packaging system.

10. An aseptic packaging system according to claim 8 wherein said heating element comprises a metallic heat conducting element comprising chromium and nickel, and a metallic sheath comprising stainless steel.

11. An aseptic packaging system according to claim 10 wherein said metallic heat conducting element is suspended within said metallic sheath in an insulative layer comprising magnesium oxide.

12. An aseptic packaging system according to claim 9 wherein said slidably cooperating plate comprises a pair of notches located on opposite edges of said slidably cooperating plate, said air flow entry member comprising adjustment means which engage said notches, said adjustment means being selectively adjustable, said adjustment means being adapted to cause said slidably cooperating plate to move relative to said fixed plate so as to effect a change in the rate of the flow of air through the orifices of the slidably cooperating plate and the fixed plate respectively without compromising the sterility of the aseptic packaging system.

13. An aseptic packaging system according to claim 8 wherein said means for connecting said heating element to said electrical circuit comprises a pair of channels, each one of said channels being adapted to receive one of said connector plates.

14. An aseptic packaging system according to claim 8 wherein said heating element comprises a plurality of coiled members joined together, said coiled members being oriented parallel to each other.

* * * * *

UNITED STATES PATENT AND TRADEMARK OFFICE

CERTIFICATE OF CORRECTION

PATENT NO. : 5,303,325

DATED : April 12, 1994

INVENTOR(S) : Pasternak, et al.

It is certified that error appears in the above-identified patent and that said Letters Patent is hereby corrected as shown below:

At Column 12, line 23, "directing the air flow egress," should be -- directing the air flow to the heating element, and said housing comprising means for channeling air flow egress, --

Signed and Sealed this

Twenty-sixth Day of July, 1994

*Attest:*

*Attesting Officer*

BRUCE LEHMAN

*Commissioner of Patents and Trademarks*